US006668494B2

(12) United States Patent
Christen et al.

(10) Patent No.: US 6,668,494 B2
(45) Date of Patent: Dec. 30, 2003

(54) DOOR FRAME AT ELEVATOR SHAFT DOORS

(75) Inventors: Jules Christen, Inwil (CH); Roland Weidmann, Blaubeuren (DE); Peter Spiess, Meggen (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/145,527

(22) Filed: May 14, 2002

(65) Prior Publication Data

US 2002/0178663 A1 Dec. 5, 2002

(30) Foreign Application Priority Data

May 14, 2001 (EP) ..... 01810473

(51) Int. Cl.[7] ..... B66B 9/00; E04H 6/06
(52) U.S. Cl. ..... 52/30; 52/204.1
(58) Field of Search ..... 52/30, 204.1; 187/325

(56) References Cited

U.S. PATENT DOCUMENTS 4,530,189 A * 7/1985 Randall ..... 52/30
5,445,244 A * 8/1995 Ketonen ..... 52/30
5,673,770 A * 10/1997 Friedman ..... 52/30

FOREIGN PATENT DOCUMENTS

| | | |
|---|---|---|
| DE | 2 245 156 | 3/1974 |
| EP | 0 534 789 | 3/1993 |
| EP | 0 621 224 | 10/1994 |
| JP | 11335011 | 12/1999 |

* cited by examiner

*Primary Examiner*—Carl D. Friedman
*Assistant Examiner*—Nahid Amiri
(74) *Attorney, Agent, or Firm*—MacMillan, Sobanski & Todd, LLC

(57) ABSTRACT

An elevator shaft door frame has posts of a basic configuration that can be combined with cladding profile members of different shape and size. The posts include a plate-like profile member with two U-shaped corrugations and a plate fastened to the profile member and covering the open rear side of the corrugations. A decorative cladding profile member is fastened to the post and has one U-shaped profile member abutting and fastened to the plate and another U-shaped profile member abutting and fastened to the one U-shaped profile member.

11 Claims, 3 Drawing Sheets

DOOR FRAME AT ELEVATOR SHAFT DOORS

BACKGROUND OF THE INVENTION

The present invention relates to a door frame for elevator shaft doors, wherein the door frame is assembled from at least two posts and an upper part.

Door frames of that kind are used for edging or trimming the rough masonry of the wall openings which lead to the elevator shaft. In that case special door frames have to be made for each installation respectively according to the size of the wall opening, the thickness of the masonry, the type of elevator shaft doors employed and the wishes of the customer. These different door frames must be fabricated and kept in stock, which contributes to cost increase of an elevator installation.

SUMMARY OF THE INVENTION

The present invention concerns an elevator shaft door frame and is therefore based on the object of providing a door frame which is in accordance with the two post and an upper part assembly, but does not have this disadvantage.

This object is met by the door frame according to the present invention. In that case, the posts are conceived as basic elements that can be combined with cladding profile members of different shape and size.

In a preferred embodiment, the posts each consist of a plate-like profile member with two U-shaped longitudinal corrugations formed therein having open front sides, and a plate fastened to the profile member and covering the open front sides of the corrugations. The door frame post includes a decorative cladding profile member fastened to the post, the cladding profile member having at least one U-shaped profile member abutting and fastened to the plate. The decorative cladding profile member has another U-shaped profile member abutting and fastened to the at least one U-shaped profile member.

The advantages achieved by the invention reside in the fact that a self-supporting, robust basic frame, in which the cladding profile members serve only for decoration and do not have a supporting function, is realized by the proposed door frame, so that it can be designed to be simpler and lighter. Further advantages result from the rational and therefore economic fabrication, which is achieved by the capability of combination, of door frames of different kind and size.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
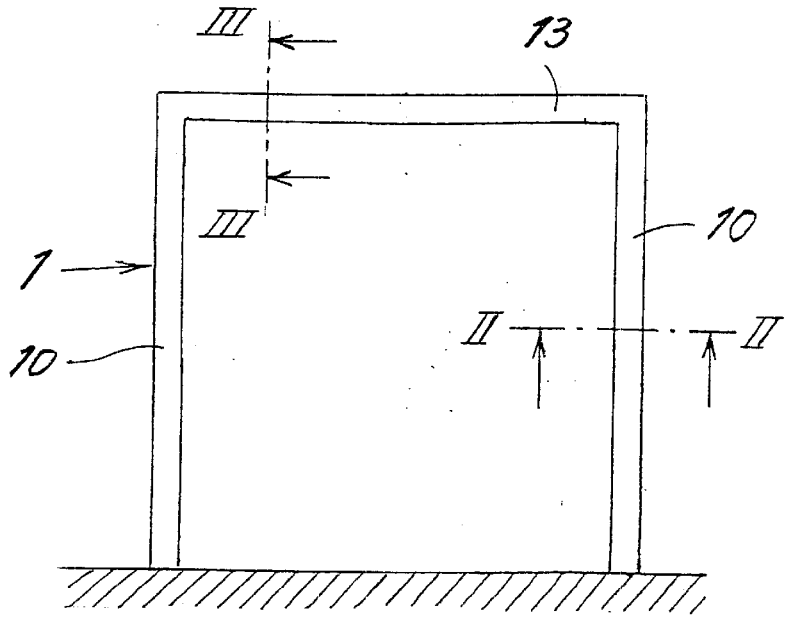
FIG. 1 is a front elevation view of a door frame apparatus in accordance with the present invention.
Figure 2:
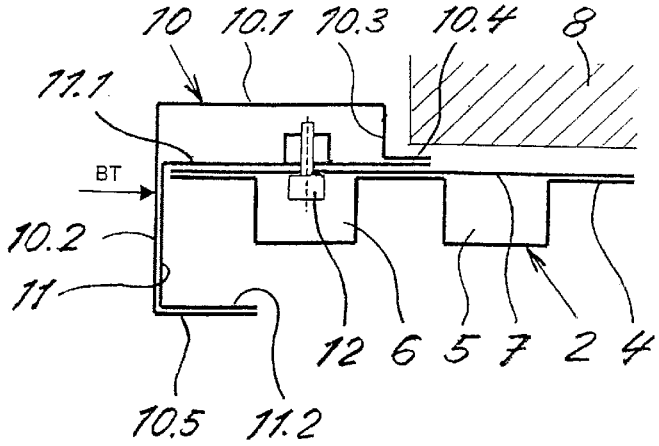
FIG. 2 is a cross-sectional view taken along the line II—II in FIG. 1 in enlarged scale, with a first embodiment cladding profile member.
Figure 3:
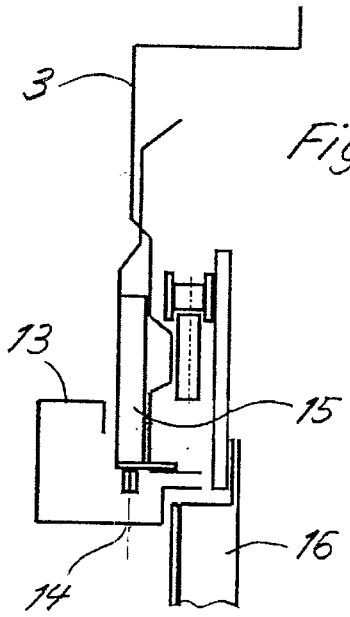
FIG. 3 is a cross-sectional view taken along the line III—III in FIG. 1 in reduced scale relative to FIG. 2.

There is shown in FIGS. 1 to 3 a door frame 1, that is constructed of at least two posts 2 and an upper part in the form of a crossbar 3. The posts 2 consist of a plate-like profile member 4 with two U-shaped longitudinal corrugations 5 and 6 spaced apart and extending into the elevator shaft. A plate 7 is fastened to the profile member 4 covering the open front (hallway) side of the corrugations 5 and 6. The posts 2 are fastened at an upper end to a surface of the building masonry 8 and at a lower end to a door threshold member (not illustrated).

A first cladding profile member 10 has, as shown in the FIG. 2 cross-section, a box-shaped, square form, wherein a first wall 10.1 of the cladding profile member 10 faces toward the building floor hallway, while a second wall 10.2, connected to an edge of and extending at right angles to the first wall, defines the door opening width BT. The first wall 10.1 has a Z-shaped first bent-over portion 10.3 forming a flange 10.4 at an edge adjacent to the masonry 8. Fastened to the cladding profile member 10 is U-shaped profile member 11, which has a longer leg 11.1 abutting the flange 10.4 and a shorter leg 11.2 abutting an inner side of a second bent-over portion 10.5 of the wall 10.2. The first cladding profile member 10 is fastened, by means of, for example, screw connections 12 to the posts 2.

One of the first cladding profile members 10 is also used as a head member 13 of the door frame cladding (FIG. 3) and is, as not further illustrated and described, connected with the vertically extending cladding profile members 10 fastened to the posts 2. Provided in the head member 13 is a bore 14 for the actuation of an unlocking device 15, by means of which a shaft door 16 can be unlocked in emergency cases.

Figure 4:
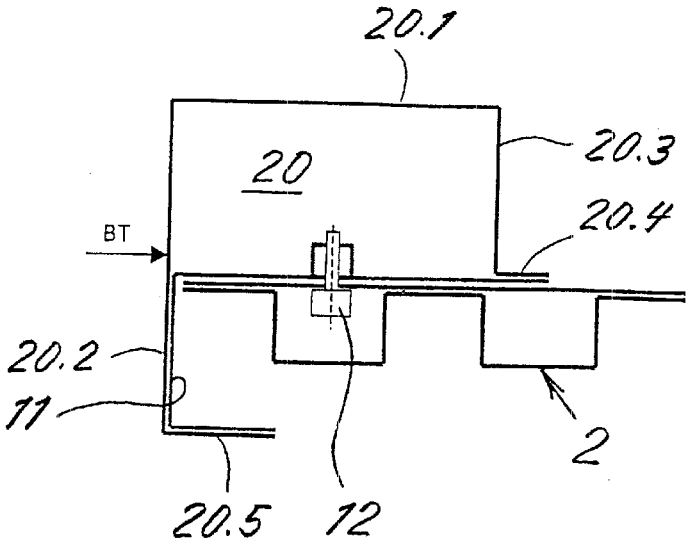
FIG. 4 is a cross-sectional view similar to FIG. 2, but with a second embodiment cladding profile member.

According to FIG. 4, a second embodiment cladding profile member 20 has the same construction as the first cladding profile member 10, but is larger wherein, for example, first and second walls 20.1 and 20.2 are twice as wide as the walls 10.1 and 10.2 respectively. A first bent-over portion 20.3 is correspondingly wider than the bent-over portion 10.3, while a flange 20.4 and a second bent-over portion 20.5 have the same dimensions as the flange 10.4 and the bent-over portion 10.5 respectively. In the first and second embodiments, the cladding profile members 10 and 20 are a first U-shaped profile member abutting and fastened to the second U-shaped profile member 11.

Figure 5:
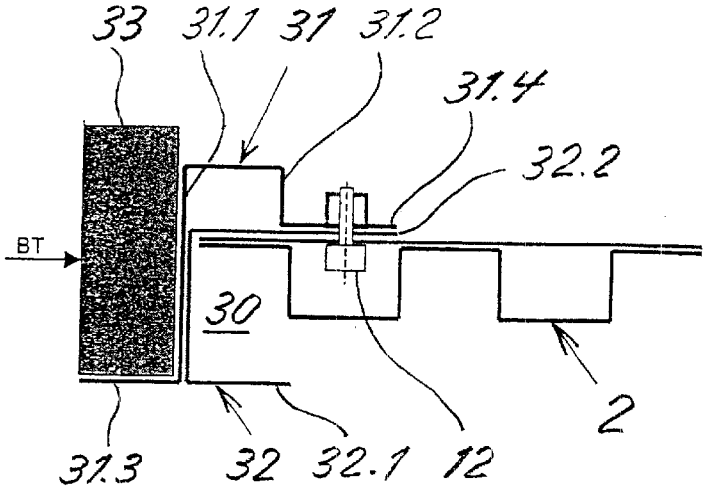
FIG. 5 is a cross-sectional view similar to FIG. 2, with a third embodiment cladding profile member.

According to FIG. 5, a third embodiment cladding profile member 30 has a first U-shaped profile member 31 with legs 31.1 (longer) and 31.2 (shorter) of unequal length, which legs are bent over and form oppositely extending first and second flanges 31.3 and 31.4 respectively. Fastened to the first U-shaped profile member 31 is a second U-shaped profile member 32 with legs 32.1 and 32.2 of unequal length, the shorter leg 32.1 of which is aligned with and extends in the opposite direction as the flange 31.3 and the longer leg 32.2 of which abuts the flange 31.4. Contact surfaces for a further cladding element 33, which, for example, can be made of marble, are formed by the leg 31.1 and the flange 31.3. The third cladding profile member 30 is fastened to the posts 2 by means of the screw connections 12.

Figure 6:
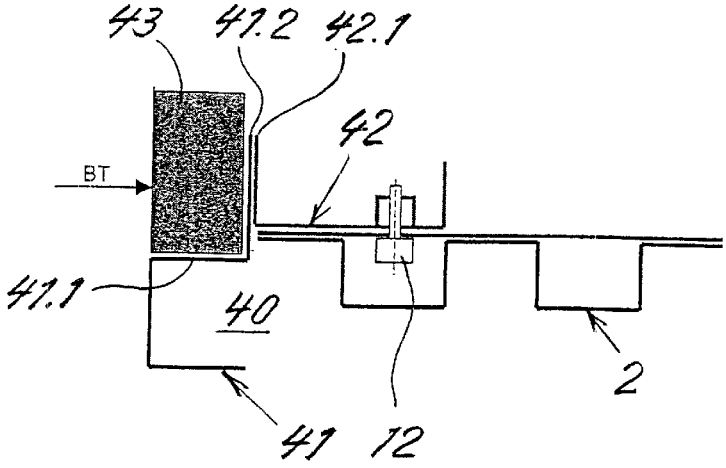
FIG. 6 is a cross-sectional view similar to FIG. 2, with a fourth embodiment cladding profile member.

A fourth embodiment cladding profile member 40 is shown in FIG. 6 as having a first U-shaped profile member 41, one leg 41.1 of which has a bent-over flange 41.2 which is connected with a leg 42.1 of a second U-shaped profile member 42. Contact surfaces for a further cladding element 43, made of, for example, marble, are formed by the leg 41.1 and the flange 41.2 of the first U-shaped profile member 41. The fourth cladding profile member 40 is fastened to the posts 2 by means of the screw connections 12.

Figure 7:
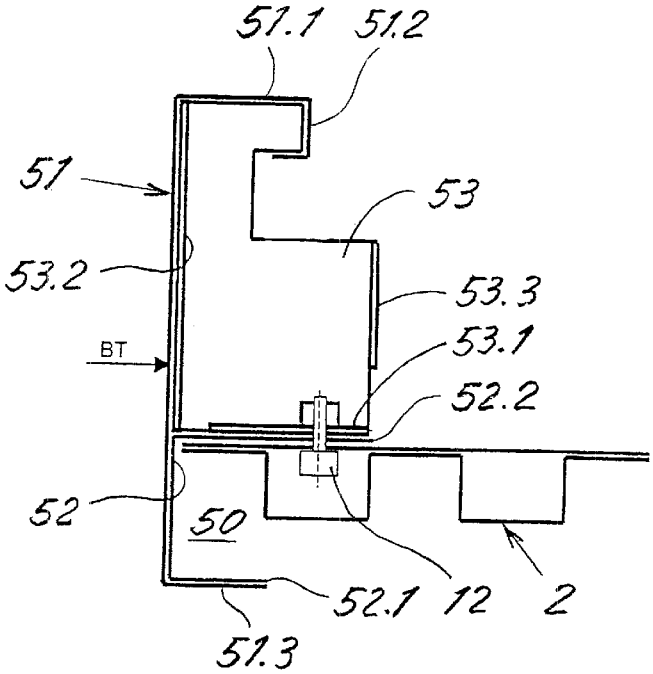
FIG. 7 is a cross-sectional view similar to FIG. 2, with a fifth embodiment cladding profile member.

According to FIG. 7, a fifth embodiment cladding profile member 50, that is particularly suitable for dry masonry, has a first U-shaped profile member 51, at a first leg 51.1 of which a hook-shaped bent-over portion 51.2 is provided. A second, narrower U-shaped profile member 52 with legs of unequal length is fastened to the first U-shaped profile member 51, wherein a shorter leg 52.1 abuts the inner side of another leg 51.3 of the first U-shaped profile member 51. Arranged in the first U-shaped profile member 51 are reinforcing plates 53, which engage at one end in the hook-shaped, bent-over portion 51.2 and rest at the other end by a first bent-over portion 53.1 on a longer leg 52.2 of the second U-shaped profile member 52. The reinforcing plates 53 have a second bent-over portion 53.2 that bears against the inner wall of the first U-shaped profile member 51 and is fastened thereto by, for example, gluing. A third bent-over portion 53.3 of the reinforcing plates 53 serves for fastening to the dry masonry (not illustrated). The fifth cladding profile member 50 is fastened to the posts 2 by means of the screw connections 12.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door frame for elevator shaft doors, the door frame being assembled from at least two posts and an upper pat, comprising:

a pair of vertically extending posts;

an upper part extending between upper ends of said posts; and a pair of decorative cladding profile members each fastened to one of said posts and spaced therefrom by an associated profile member, said cladding profile members each having a first U-shaped profile member with a leg having a bent-over flange connected to a leg of a second U-shaped profile member being said associated profile member, said leg and said flange of said first profile member forming contact surfaces for a further cladding element.

2. The door frame according to claim 1 wherein each of said posts has a substantially planar profile member with two U-shaped longitudinal corrugations formed therein and a plate fastened to said profile member and covering an open front side of said corrugations.

3. The door frame according to claim 1 wherein each said cladding profile member is in cross-section formed in a partly box-like, square shape, with a first wall for facing a building floor hallway, a second wall connected to and extending at right angles to said first wall, said second walls defining a door opening width, said first wall having a Z-shaped, first bent-over portion forming a flange, a each said associated profile member being a U-shaped profile member fastened to said cladding profile member with a longer leg abutting said flange and a shorter leg abutting an inner side of a second bent-over portion of said second wall.

4. The door frame according to claim 1 wherein each said cladding profile member has a first U-shaped profile member with a pair of legs of unequal length that are bent over and form first and second flanges, and said associated profile member is a second U-shaped profile member with a pair of legs of unequal length and being fastened to said first U-shaped profile member, wherein a shorter one of said legs of said second profile member is aligned with said first flange and a longer one of said legs of said second profile member abuts said second flange, and a longer one of said legs of said first profile member and said first flange form contact surfaces for a further cladding element.

5. The door frame according to claim 1 wherein each said cladding profile member has a first U-shaped profile member with a first leg having a hook-shaped bent-over portion and a second leg, said associated profile member being a second U-shaped profile member having legs of unequal length and being fastened to said first U-shaped profile member, a shorter one of said legs of said second profile member abutting an inner side of said second leg of said first U-shaped profile member, at least one reinforcing plate arranged in said first U-shaped profile member engaging at one end in said hook-shaped, bent-over portion and abutting at another end with a first bent-over portion against a longer one of said legs of said second U-shaped profile member, said at least one reinforcing plate having a second bent-over portion fastened to said first U-shaped profile member.

6. The door frame according to claim 5 wherein said at least one reinforcing plate is fastened to said first U-shaped profile member by gluing.

7. The door frame according to claim 1 wherein said cladding profile members are fastened to said posts by screw connections.

8. A door frame post for elevator shaft doors, the door frame being assembled from at least two of the posts and an upper pat, the post comprising:

a vertically extending a substantially planar profile member with two U-shaped longitudinal corrugations formed therein having open front sides; and a plate fastened to said profile member and covering said open front sides of said corrugations.

9. The door frame post according to claim 8 including a decorative cladding profile member fastened to said post, said cladding profile member having at least one U-shaped profile member abutting and fastened to said plate.

10. The door frame post according to claim 9 wherein said decorative cladding profile member has a another U-shaped profile member abutting and fastened to said at least one U-shaped profile member.

11. A door frame for elevator shaft doors, the door frame being assembled from at least two posts and an upper part, comprising:

a pair of vertically extending posts, each of said posts having a substantially planar profile member with two U-shaped longitudinal corrugations formed therein;

a plate fastened to each said profile member and covering an open front side of said corrugations;

an upper part extending between upper ends of said posts; and a pair of decorative cladding profile members each fastened to one of said posts, said cladding profile members being selected from a plurality of cladding profile member designs of different shapes and sizes.

* * * * *